United States Patent [19]

Schwarz

[11] Patent Number: 4,860,960

[45] Date of Patent: Aug. 29, 1989

[54] MIXING APPARATUS CONTAINING A MIXER AND A PULVERISER

[75] Inventor: Manfred Schwarz, Paderborn, Fed. Rep. of Germany

[73] Assignee: Gebruder Lodige Maschinenbaugesellschaft mbH, Paderborn-Wewer, Fed. Rep. of Germany

[21] Appl. No.: 226,678

[22] Filed: Aug. 1, 1988

[30] Foreign Application Priority Data

Aug. 28, 1987 [DE] Fed. Rep. of Germany ..... 3728710

[51] Int. Cl.[4] ..... B02C 18/22

[52] U.S. Cl. ..... 241/89.3; 241/101 B; 241/199.12

[58] Field of Search ..... 241/101 B, 2, 199.9, 241/199.12, 86.1, 89.3, 46.06, 74

[56] References Cited

U.S. PATENT DOCUMENTS 3,743,192 7/1973 Otto ..... 241/101 B 4,413,790 11/1983 Lipp ..... 241/101 B

OTHER PUBLICATIONS

Tekmar 1985: Unique Scientific and Process Equipment, 241/2.

*Primary Examiner*—Mark Rosenbaum

*Attorney, Agent, or Firm*—Merchant, Gould, Smith, Edell, Welter & Schmidt

[57] ABSTRACT

Mixing apparatus comprises a container which may be in the form of a hollow cylinder with its axis horizontal. It contains mixing means mounted to rotate within the container about its axis and in addition a pulveriser mounted in the cylindrical wall of the container. Whereas in known mixers of this kind the additional pulveriser comprises so-called knife heads which do not in every case grind down sufficiently rapidly and uniformly the material to be treated, in the mixer now proposed the grinding of the material is improved by the addition of a shearing effect. The pulveriser comprises two concentrically arranged relatively rotatable shearing rings and is in a position to disintegrate even materials which are difficult to treat, such as damp materials, rapidly and at the same time efficiently. Fluid can also be added in the region of the pulveriser without the material being caused to form into lumps.

18 Claims, 1 Drawing Sheet

FIG.1
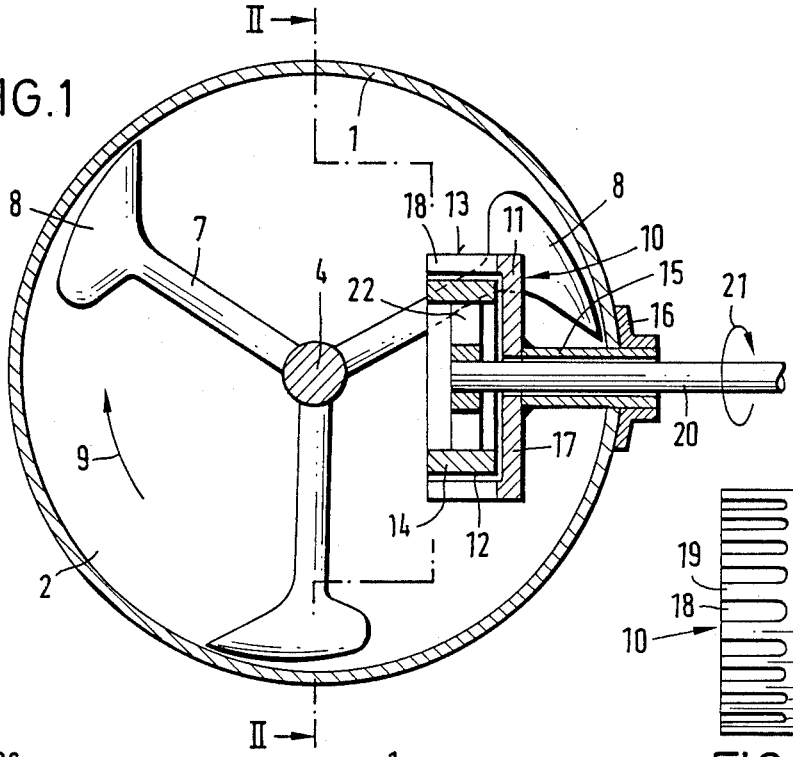
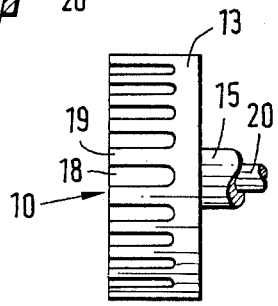
FIG.3
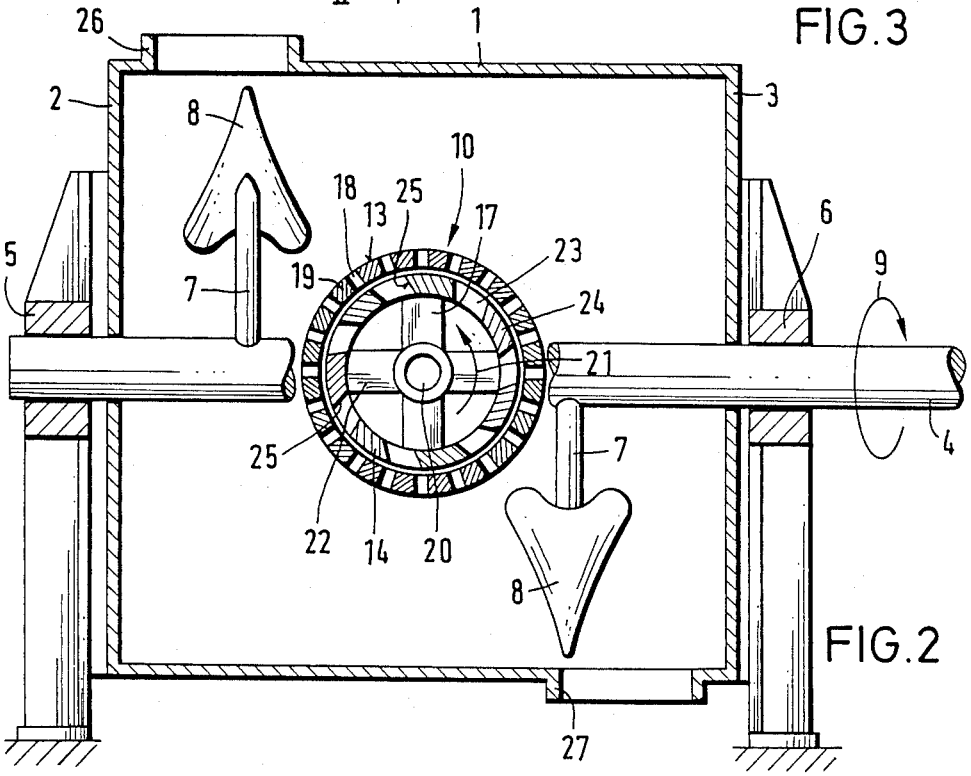
FIG.2

MIXING APPARATUS CONTAINING A MIXER AND A PULVERISER

The invention relates to mixing apparatus which comprises a container, for example of cylindrical shape, mixing means arranged within the container and comprising a rotatably mounted shaft with mixing tools secured on it on radial arms, and with at least one pulveriser mounted in the wall of the container, the pulverising elements of the pulveriser being arranged at such a spacing from the wall of the container that the mixing tool of the mixing apparatus can be caused to pass between the wall of the container and the pulveriser so that the tool and the pulveriser do not mutually interfere, but complement one another in their effect.

In known mixing apparatus of this kind the mixing tools are formed for example as ploughs, whilst the pulverisers are so-called knife heads which have straight or concavely curved knives arranged one above another in one or more planes, the shape and length of the knives being such that they fit in with the envelope curves of the paths swept out by the ploughshare-like mixing tools, so that the envelope curves swept out by the mixing tools and the envelope curves swept out by knives of the pulverisers are closely matched to one another without actually intersecting, so that the components are not able to come into mutual contact.

Although outstanding mixing results can achieved with such mixers in respect of many materials, with simultaneous disintegration of those materials which have an inclination to form lumps, they are not entirely satisfactory in certain situations of use as the knives of the pulveriser rotate freely and the material on which they work is not forced sufficiently positively against the knives, and there is therefore no shearing action in the pulveriser. However a shearing action is a desirable in particular when the formation of lumps arises in the material, for example in the mixing and drying of extremely damp materials or in the mixing of dry materials with damp or indeed flowable other materials.

The object of the invention is to solve the problem of improving a mixer of the kind stated in the introduction above in such a way that the disintegrating action on the materials to be mixed or on their components effected by the pulverisers is improved by the addition of a shearing action.

This problem is solved in a mixer of the kind stated in the introduction and having the features of the present invention. Advantageous features which characterize the invention are the subject matter of the claims annexed hereto and forming part hereto.

By virtue of the invention there is provided a mixer which exerts a deliberate shearing action on the material to be mixed, the material being fed from the mixing tools to the pulverisers, these tools being preferably of the shape of ploughshares. The pulverisers have shearing rings which have a shearing action and thereby a particularly effective pulverising action on the material to be mixed, so that the formation of lumps is effectively eliminated and any lumps which are formed despite this are rapidly and effectively disintegrated.

Preferably the one shearing ring of each pulveriser is formed as a rotor and the other shearing ring is formed as a stator so that only one of the two has to be driven and thereby needs to be rotatably mounted. In this way the power needed to drive the pulveriser can be kept low, whilst at the same time the outlay in bearings for rotatable components is no higher than necessary.

An embodiment of a mixer according to the invention is illustrated diagrammatically in the accompanying drawings, in which:

FIG. 1 is a cross-section through the mixer at the level of a pulveriser which is incorporated in it.

FIG. 2 is a longitudinal section through the mixer on the line II—II in FIG. 1 and FIG. 3 is a side view of the pulveriser incorporated in the mixer of FIG. 1 and 2.

The mixer illustrated in the drawing has a fixed, i.e. non-rotatably mounted cylindrical container 1 with flat end walls 2 and 3. Through this container 1 there extends axially a shaft 4 mounted to rotate in bearings 5 and 6.

Secured on the shaft 4 on radial arms 7 are mixing tools 8 shaped like ploughshares, their paths lying near the inner wall of the cylindrical container 1, and they are rotated in the direction of an arrow 9 within the container 1 when the shaft is driven by a motor, not shown.

The arms 7 of the ploughshare-like mixing tools are arranged offset both circumferentially and axially, so that the materials to be mixed, when engaged by the tools 8, are continually displaced back and forth and thereby intensively swirled about and thoroughly mixed.

In the mixer illustrated there is a pulveriser 10 provided in its central region, projecting into the container 1 from the side. This pulveriser comprises a stator 11 and a rotor 12 which form mutually concentric shearing rings 13 and 14.

The stator 11 is mounted on a tubular member 15 which is secured to the container 1 by means of sleeve 16 secured on the outer face of the container. On that end of the tubular member 15 which is inside the container 1 there is secured a set of spokes 17, and in the example shown they are rigidly welded, and they carry the shearing ring 13 of the stator 11.

The shearing ring 13 of the stator 11 has a number of radial slots 18 which extend over that part of the ring 13 which lies beyond the spokes 17 and they are relatively small so that relatively wide shearing teeth 19 are present between the slots 18 which are rectangular or square in plan view as can be seen particularly clearly in FIGS. 2 and 3.

The rotor 12 arranged concentrically within the stator is mounted on a shaft 20 which extends through the tubular member 15 and the wall of the container 1 and can be driven in the direction of an arrow 21 by a motor, not shown. Also in the drawing the bearing of the shaft 20 is not illustrated in detail.

Secured to that end of the shaft 20 which is present within the container 1, to rotate with it, is a set of spokes 22 which carries the shearing ring 14 of the rotor 12. This shearing ring 14 has relatively wide slots 23 between which shearing teeth 24 are defined. The slots 23 are not only wider than the virtually radial slots 18 in the outer shearing ring 13 but also they do not extend radially but inclined, i.e. on a spiral path so that both the slots 23 and also the shearing tools 24 present between them have a trapezoidal section. Accordingly each of the individual shearing teeth 24 has a knife-shaped cutting edge 25 which is present at the leading edge of the shearing ring 14 of the rotor 12 and these edges cooperate with the inner faces of the teeth 19 of the fixed shearing ring 13 of the stator in the slots 18 present between them and accordingly they achieve the desired shearing action when the rotor is driven.

As can be seen particularly in FIG. 1, the ploughshare-like mixing tools 8 are able to pass between the inner wall of the container 1 and the spokes 17 of the stator 11, so that they throw the material present in the container 1 onto the pulveriser 10 from all sides. In this way it is made certain that the material to be mixed also reaches the region where the pulveriser 1 is, and at that point can be worked upon in the desired manner by the pulveriser in order to eliminate lumps and to obtain a consistent mixing result and a uniform mixed product. Accordingly this mixer is particularly suitable for the treatment of materials which are known to be prone to the formation of lumps, for example damp materials.

The container 1 is provided at one end with a spigot 26 serving as an inlet connection and is provided at its opposite end with a spigot 27 serving as the outlet. These spigots could be provided with couplings or shut-off valves or caps. In the embodiment illustrated the mixer is designed for continuous operation, but it can also be employed for batch operation.

Although in the embodiment illustrated diagrammatically the teeth 19, 24 on the shearing rings 13 of the stator 11 and the rotor 12 have a trapezoidal or sharply edged cross-section and are provided on those surfaces which face towards one another with mutually co-operating cutting edges 25, the teeth could also have a different cross-section, for example a round, oval, square or rectangular cross-section. In fact the pulveriser 10 could be constructed as a kind of impact mill which breaks up the material present in the cylindrical container 1, the latter being arranged with its longitudinal axis horizontal.

The radial openings between the teeth 19 and 24 of the stator 11 and/or the rotor 12 preferably have a width of between about 3 and 10 mm. Such choice of dimensions achieves a reliable and effective pulverising of the materials to be treated. However in individual cases the widths of the gaps could also be smaller or larger.

According to a further feature the radial arms 22 of the rotor 12 could be of shaped profile, such as to effect a deliberate feeding action into the region of the stator 11 and the rotor 12.

The width of the gap between the stator 11 and the rotor 12 can differing width values and preferably lies in the range of 1 to 5 mm. With a gap in this range there is achieved a good and satisfactory co-operation of the teeth of the rotor and the stator.

According to a further feature the stator 11 and the rotor 12 are made of particularly hard material, although it is sufficient in some circumstances to provide only those particular surfaces of them which are exposed to wear with a hard material coating.

According to another feature the stator is mounted on a pair of concentric tubular members which define an annular pipe allowing a fluid to be introduced from outside into the neighbourhood of the stator 11 and rotor 12; such an arrangement could be employed where a fluid is fed to the materials present in the container for mixing, during its treatment, or where the material is to be moistened.

According to a still further feature the shearing gap between the stator 11 and the rotor 12 can be made slightly eccentric, that is to say, the rotor 12 can be mounted eccentrically with respect to the stator 11. In this way a pulsating grinding and milling action is obtained.

The pulveriser 10, which can be described as a grinding and milling member or also as an impact mill, is preferably arranged in the middle of the side or in the lower region of the container 1. It could lie anywhere in the region from 0° to 180°, and preferably in a region between 20° and 160°, to the vertical through the horizontal longitudinal axis of the container 1 and to the horizontally shaft 4 of the mixing means.

I claim:

1. Mixing apparatus for mixing materials comprising a container, said container being generally cylindrical in shape, mixing means arranged in said container, said mixing means comprising a rotatably mounted shaft, radial arms thereon, and mixing tools on said radial arms, and said apparatus further comprising at least one pulveriser, said pulveriser being mounted in a wall of said container and having pulverising elements arranged at such a spacing from said wall that said mixing tools move material between said wall and said pulverising elements allowing said pulveriser to receive material, said pulveriser comprising two mutually concentric relatively rotatable shearing rings.

2. The mixing apparatus set forth in claim 1 wherein said two shearing rings are provided with upstanding teeth.

3. The mixing apparatus set forth in claim 2 wherein said teeth of said two shearing rings are of respective different shape and/or size.

4. The mixing apparatus set forth in claim 2 wherein one of said shearing rings is formed as a stator and the other of said shearing rings is formed as a rotor.

5. The mixing apparatus set forth in claim 2 wherein at least the teeth of one of said shearing rings have a circular, oval, square, rectangular or trapezoidal cross-section and if necessary said teeth are provided with mutually co-operating cutting edges on those surfaces of said shearing rings which face one another.

6. The mixing apparatus set forth in claim 5 wherein the radial gaps between said teeth have a width of between about 3 and 10 mm.

7. The mixing apparatus set forth in claim 1 wherein said teeth of said two shearing rings are of respective different shape and/or size.

8. The mixing apparatus set forth in claim 7 wherein one of said shearing rings is formed as a stator and the other of said shearing rings is formed as a rotor.

9. The mixing apparatus set forth in claim 7 wherein said teeth of a first one of said shearing rings have a substantially square or rectangular cross-section, relatively small radial gaps being present between said teeth, and wherein the teeth on the other of said shearing rings are longer in plan view than said teeth of said first ring and have a trapezoidal cross-section, substantially spirally extending broad gaps being provided between the teeth of said other ring.

10. The mixing apparatus set forth in claim 9 wherein one of sid shearing rings is formed as a stator and the other of said shearing rings is formed as a rotor.

11. The mixing apparatus set forth in claim 1 wherein one of said shearing rings is formed as a stator and the other of said shearing rings is formed as a rotor.

12. The mixing apparatus set forth in claim 11 wherein said stator is the outer one of said shearing rings.

13. The mixing apparatus set forth in claim 11 including said stator being secured to said tubular member, and including a driving shaft for the shearing ring that forms said rotor, said shaft extending through said tubular member.

14. The mixing apparatus set forth in claim 11 wherein the gap between said rotor and said stator is between 1 and 5 mm wide.

15. The mixing apparatus set forth in claim 11 wherein at least the wearing surfaces of said rotor and stator are made from hard material.

16. The mixing apparatus set forth in claim 11 wherein the axis of said stator and rotor is arranged at an angle of 20° to 160° to a vertical line through said horizontal axis of said container.

17. The mixing apparatus set forth in claim 11 wherein said rotor comprises radial arms and said radial arms of said rotor are sized and configured to move material into the region of said rotor and stator.

18. The mixer set forth in claim 1 wherein said two shearing rings are of annular shape plan view.

* * * * *

UNITED STATES PATENT AND TRADEMARK OFFICE

CERTIFICATE OF CORRECTION

PATENT NO. : 4,860,960

DATED : August 29, 1989

INVENTOR(S) : Manfred Schwarz

It is certified that error appears in the above-identified patent and that said Letters Patent is hereby corrected as shown below:

In column 1, line 53, after the word "forming" please add --a further --.

In column 4, line 44, please delete the word "said" (first occurrence).

In column 4, line 68, after the word "including" and before the word "said" please add the following --a tubular member, the shearing ring that forms--.

In column 6, line 10, after the word "shape" please add --in--.

Signed and Sealed this

Sixteenth Day of April, 1991

*Attest:*

HARRY F. MANBECK, JR.

*Attesting Officer*

*Commissioner of Patents and Trademarks*